US010568378B2

(12) United States Patent
Von Dunten et al.

(10) Patent No.: US 10,568,378 B2
(45) Date of Patent: Feb. 25, 2020

(54) HELMET STRAP, HELMET, AND METHOD OF MANUFACTURING A HELMET STRAP

(71) Applicant: ABUS August Bremicker Söhne KG, Wetter-Volmarstein (DE)

(72) Inventors: Marc Von Dunten, Essen (DE); Matthias Ocklenburg, Darmstadt (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 255 days.

(21) Appl. No.: 15/727,959

(22) Filed: Oct. 9, 2017

(65) Prior Publication Data

US 2018/0098593 A1 Apr. 12, 2018

(30) Foreign Application Priority Data

Oct. 10, 2016 (DE) ..... 10 2016 119 242

(51) Int. Cl.

| | |
|---|---|
| ***A42B 3/08*** | (2006.01) |
| ***D03D 11/02*** | (2006.01) |
| ***D03D 3/00*** | (2006.01) |
| ***D03D 1/00*** | (2006.01) |

(52) U.S. Cl.

CPC ..... *A42B 3/08* (2013.01); *D03D 1/0094* (2013.01); *D03D 3/005* (2013.01); *D03D 11/02* (2013.01); *D10B 2507/00* (2013.01)

(58) Field of Classification Search

CPC ..... A42B 3/08; D03D 1/0094; D03D 3/005; D03D 11/02

USPC ..... 2/421

See application file for complete search history.

(56) References Cited

U.S. PATENT DOCUMENTS

| | | | | |
|---|---|---|---|---|
| 2002/0118532 | A1* | 8/2002 | Gates | A42B 3/044 362/105 |
| 2005/0262619 | A1 | 12/2005 | Musal et al. | |
| 2011/0277222 | A1 | 11/2011 | Garneau et al. | |
| 2016/0007670 | A1* | 1/2016 | Connelly | A42B 3/205 2/421 |
| 2018/0352909 | A1* | 12/2018 | Fava | A42B 3/066 |

FOREIGN PATENT DOCUMENTS

| | | | |
|---|---|---|---|
| DE | 1976998 | U | 1/1968 |
| DE | 29500809 | U1 | 3/1995 |
| EP | 0581460 | A1 | 2/1994 |
| EP | 1513424 | B1 | 4/2006 |
| FR | 95308 | E | 8/1970 |
| GB | 2380924 | A | 4/2003 |

* cited by examiner

*Primary Examiner* — Gloria M Hale

(74) *Attorney, Agent, or Firm* — Harness, Dickey & Pierce, P.L.C.

(57) ABSTRACT

A helmet strap for fastening a helmet to a head comprises at least one strap belt having a Y shape that has a first arm, a second arm and a third arm to be fastened to the helmet at a respective helmet side by two of the arms and for the remaining arm to be able to extend up to a chin region of the head. In this respect, the strap belt comprises a first part belt that extends without interruption along the first and third arms and a second part belt that extends without interruption along the second and third arms, wherein the first and second part belts are fixedly interconnected along the third arm or are formed materially integrally with one another along the third arm.

18 Claims, 2 Drawing Sheets

HELMET STRAP, HELMET, AND METHOD OF MANUFACTURING A HELMET STRAP

Figure 1:
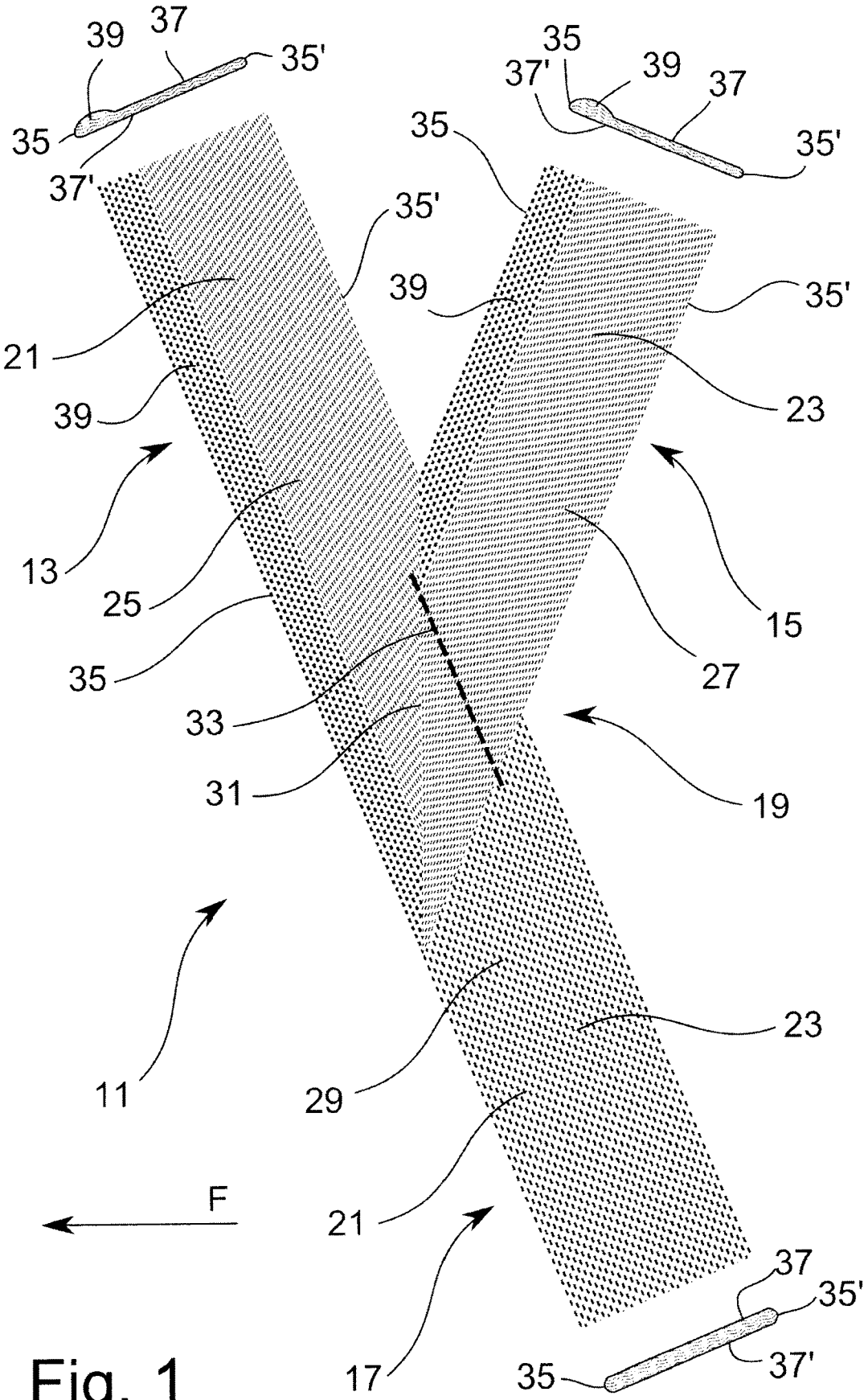

The present invention relates to a helmet strap for fastening a helmet to a head, to a helmet having such a helmet strap, and to a method of manufacturing such a helmet strap.

A helmet strap for fastening a helmet to a wearer's head can comprise a strap belt having a Y shape that has a first arm, a second arm and a third arm to be fastened to the helmet at a respective helmet side by two of the arms and for the remaining arm to be able to extend up to a chin region of the head. The strap belt can be arranged at the helmet, for example, such that the two arms fastened to the helmet meet at a junction beneath an ear of the head wearing the helmet such that the ear is surrounded by the two arms and by the helmet. The further arm can then extend from the junction to the chin region.

A helmet strap typically comprises two such strap belts that are provided at opposite helmet sides—the one at the left, the other at the right. The ends of the two arms of both strap belts extending up to the chin region can then be releasably connected to one another there, for instance by means of a buckle or of another closure apparatus, such that the helmet is reliably held at the head as long as the closure apparatus is closed. Provision can be made in this respect that at least one of the mutually connected arms of the two strap belts is adjustable in its effective length, that is in its length contributing to the connection of the helmet to the head, for instance in that the position of the closure apparatus is variable at least one of the arms.

The respective strap belt can in particular comprise a first part belt and a second part belt to produce the named Y shape. The two ends of the first part belt can be fastened to the helmet, for example, and can thus form the two arms of the Y shape connected to the helmet. The second part belt can then be connected to the first part belt in a middle region, for instance, by means of a clip or of a fastener or by a knot, a loop or by simple sewing on and can extend from there as the further arm to the chin region. Alternatively to this, both the first part belt and the second part belt can, for example, each be fastened to the helmet and can extend up to the chin region, with a clip, a fastener or another connection element being provided that holds the first and second part belts together at the junction such that the two part belts extend substantially in parallel with one another from the junction up to the chin region.

It is comparatively simple from a construction aspect to form the Y shape of the strap belt in such a manner or in a similar manner, but typically requires an additional connection element in the region of the junction. In addition, there is the risk with such a design in which the part belts are fastened to one another by means of a connection element or, for instance by a knot, by a loop or by simple sewing on, to form the Y shape that the connection can be released under high forces which can in particular occur in the case of a fall so that the safety of the helmet wearer is at risk. For example, the respective connection element can break or the connection can tear. However, it is important for the reliable fastening of the helmet to the head that the Y shape of the respective strap belt, in particular of both strap belts, is maintained.

It is an object of the invention to provide a helmet strap for fastening a helmet to a head having improved safety, to provide a helmet having such an improved helmet strap, and to provide a method of manufacturing such an improved helmet strap.

The object is satisfied by a helmet strap having the features of claim 1.

The fact in particular contributes to the improved safety in this respect that the first part belt extends without interruption along the first and second arms and that the second part belt extends without interruption along the second and third arms, with the first and second part belts being fixedly interconnected along the third arm or being formed materially integrally with one another along the third arm. With such a helmet strap, a first part belt and a second part belt are therefore still provided for one respective strap belt. Said first and second part belts first extend separately from one another along different arms, namely the first part belt along the first arm and the second part belt along the second arm, but are then not connected to one another by means of a connection element or in a different manner simply only in the region of the bifurcation in order to form the Y shape. Provision is rather made that the first and second part belts are fixedly interconnected along the third arm, with them even being able to be formed integrally with material continuity for a further improved strength.

There is therefore no punctiform connection of the two part belts, but the part belts are rather fixedly connected to one another over a specific distance, namely along the third arm. The connection consequently extends at least linearly along the third arm. The two part belts are furthermore preferably fixedly interconnected in an areal manner, preferably over their total common width. In this manner a stability of the connection can be achieved that is respectively particularly high with respect to a punctiform connection and that contributes to the safety of the helmet strap. The first, second and third arms can in particular have the same width.

It is particularly preferred if the two part belts are fixedly interconnected or are formed materially integrally with one another along the total length of the third arm. It can, however, generally be sufficient if the connection or the integral configuration extends over a substantial part, for example of at least approximately 2 cm, preferably of at least approximately 5 cm, in length, in particular over a predominant part of the third arm.

The fixed interconnection of the first and second part belts can generally take place in different manners, for example by adhesive bonding, by sewing or by riveting or also by a shape-matched connection. In this respect, the fixed interconnection extends along the third arm, for instance along a line or over an area, and is in particular fixed in that the first and second part belts cannot be released from one another over the region of their fixed connection without damaging or destroying the connection.

A particularly reliably connection results when the first and second part belts are formed materially integrally with one another along the third arm. In other words, in the region of the integral configuration of the first and second part belts the strap belt is formed in one part since the first and second part belts do no longer appear as two generally separate (albeit mutually connected) elements in this region, but rather form a unit that is non-releasable in principle. The material integrality can in this respect be present on a molecular level, for instance when the first and second part belts are welded or fused to one another, or also on a macroscopic level, for example when the first and second part belts are woven or entwined with one another.

A contribution is furthermore made to the stability of the strap belt in that the first and second part belts each extend without interruption along the first and second arms and along the third arm. The part belts are therefore continuous and are in particular also not interrupted in the region of the bifurcation. Each of the part belts in particular per se forms a continuous unit with material integrality that cannot easily be released, in particular not without damage to the respective part belt. The part belts can, for example, each comprise a fabric whose warp threads run through the respective part belt continuously from its one end along the first and second arms respectively and along the third arm up to the opposite end. A particularly high tear resistance of the respective part belt and thus also of the strap belt overall can be achieved by a respective design of the first and second part belts without interruption.

In accordance with an advantageous embodiment, the first and second arms are provided for fastening to the helmet. The third arm along which the first and the second part belts are fixedly interconnected or are formed materially integrally with one another is consequently the one which extends from the junction of the Y shape to the chin region. Tensile forces between the helmet and the chin region can thus be taken up particularly uniformly by the strap belt since they are distributed at the helmet side over the first and second arms along which only a respective one of the part belts extends and are led together at the chin side in the third arm along which both part belts then extend.

In this respect, provision is in particular made with respect to the arrangement of the first and second arms relative to one another that the first arm is arranged relative to the second arm in the direction of travel. In other words, the first arm is arranged in front of the second arm with respect to a direction of gaze of a helmet wearer with a customary arrangement of the helmet on the head of the respective helmet wearer. The first arm is thus fastened to the helmet closer to a front side of the helmet than the second arm. The first arm in particular extends in front of a respective ear, that is in the region of a temple, of the helmet wearer when the helmet is put on, while the second arm extends therebehind.

In accordance with a preferred embodiment, the first part belt comprises a first part fabric that extends without interruption along the first arm and along the third arm and the second part belt comprises a second part fabric that extends without interruption along the second arm and along the third arm, with the first and second part fabrics being woven together along the third arm. The use of fabrics has the advantage that belts can be produced comparatively simply from it from a technical manufacturing aspect. In addition, fabrics can have a high stability, in particular a high tearing strength, and can nevertheless simultaneously offer the required flexibility for a good adaptation to the respective head shape.

In this respect, the designation of the first and second part fabrics as part fabrics should only signify, in a similar manner to the designation of the first and second part belts as part belts, that they each partly contribute to the total strap belt. The prefix "part" is in contrast not to be understood such that a part fabric or a part belt is an incomplete fabric or an incomplete belt.

It is furthermore not precluded that a respective part belt comprises further elements beyond the respective part fabric. For example, plastic inlays can be provided in a part belt to reinforce the part belt and can be surrounded by a respective part fabric, for instance. Or the respective part fabric can e.g. comprise a coating that can give the respective part belt specific surface properties.

The materially integral configuration of the first and second part belts along the third arm can take place in a simple manner in such an embodiment by weaving together the first and second part fabrics. The part fabrics then form a uniform fabric in the region of their interweaving that can then form the third arm of the strap belt or at least a substantial part thereof. In this respect, respective portions (for example respective warp threads extending in parallel with the longitudinal extent of a respective part belt) can be identified in the region of the interweaving that are to be associated with one or the other of the part fabrics. These portions are, however, are arranged alternating or mixed or entwined in a different manner and are interconnected due to the interweaving such that this does not stand in the way of the uniformity of the fabric in the region of the third arm. The part fabrics then run apart separately from one another at the junction of the Y shape of the strap belt and extend along a respective other one of the first and second arms.

Such an embodiment in particular makes possible a single-part production of the strap belt. For then the first part belt and the second part belt do first not have to be produced separately from one another and subsequently connected to one another. The first and second part belts can rather be continuously woven together, wherein they can first be woven as a common fabric and can subsequently be woven as two separate part fabrics and/or vice versa as will be explained in the following with respect to the method of manufacturing a strap belt. The single-part production in particular has the advantage that no step is required to connect the first and second part belts to one another and that the strap belt is particularly stable and tear-resistant as an element formed in one part since it has no connection that could be released.

In accordance with an embodiment the first part belt has an at least substantially straight course over its total extent along the first and third arms. The straight course is to be understood with respect to a flat and relaxed arrangement of the first part belt. The belt shape of the first part belt therefore does not have any cures or bends and the first part belt is also not kinked or folded over in a defined manner. This is not countered by the fact that the first part belt can generally be bendable, kinkable and/or foldable due to its flexibility. The straight course is in particular advantageous when the first part belt is arranged as explained above in front of the second part belt with respect to a direction of travel or gaze or with respect to a front side of the helmet. The first part belt can then extend at least substantially along a straight course from the helmet, past a temple of the head up to beneath the lower jaw to the chin region. The straight course in this respect contributes to a tight seat of the helmet on the head.

In accordance with a further embodiment, the second part belt has an angled course in the region of a transition between the second and third arms, in particular at an angle in an angular range from approximately 30° to 50°. The angled course of the second part belt can serve the purpose, in particular when the first part belt has a straight course, that the first and second arms of the Y shape of the strap belt run apart from the junction at which the arms come together so that they can extend at both sides of a respective ear of the head with a helmet placed on the head. The remaining course of the second part belt is in this respect preferably at least substantially straight, which can in turn contribute to a tight fit of the helmet.

In accordance with an advantageous further development, the second part belt is folded over along a folding edge in the region of the transition between the second and third arms to produce the angled course. With this embodiment, the angled course of the second part belt is therefore not structurally caused by the shape of the part belt. The second part belt can rather in principle, i.e. if it were not folded over, have a belt shape with a straight course. However, a defined folding over of the part belt is provided by which the angled course is produced. To produce a specific angle, the folding edge at which the second part belt is folded over is in particular aligned at an angle of approximately half this specific angle with respect to the course of the non-folded part belt; that is, for example to produce an angle of approximately 45°, it is in particular aligned at an angle of approximately 22.5° with respect to the course of the non-folded part belt.

In accordance with a further advantageous further development, sections of the second part belt that overlap one another due to the folding over are fastened to one another, in particular by means of at least one seam and/or by adhesive bonding or by welding. The fastening of the mutually overlapping sections of the folded over part belt to one another advantageously provides that the angled course of the second part belt is always maintained in a defined manner. A single seam can be sufficient in this respect to hold the overlapping sections at least substantially contacting one another. An areal connection, for instance by sewing, adhesive bonding or welding, can provide an improved purchase in comparison. Since the holding together of the overlapping sections is, however, not critical for safety as a rule, but rather only serves the basic alignment of the Y shape so that it can be suitably placed at a head side, a simple seam can be to be preferred for reasons of a simpler manufacture.

In accordance with an advantageous embodiment, at least one of the part belts has a varying thickness at least sectionally, in particular the first part belt at least along the first arm and/or the second part belt at least along the second arm. A respective part belt in particular has a flat elongate shape as a belt having two mutually opposite longitudinally extending flat sides that are connected transversely to the longitudinal extent via a respective longitudinal edge—that can also be understood as a respective narrow side depending on the extent. The thickness of a respective part belt then at least substantially corresponds to the extent of the part belt in a direction perpendicular to the flat sides. The width of the respective part belt, that is preferably at least substantially constant for the first and/or second part belt. is then defined in a corresponding manner by the respective spacing of the longitudinal edges from one another.

The respective part belt can, for example, have a larger or smaller thickness in a middle region of its respective width than toward the margins, that is than in the region of one or both longitudinal edges. In this respect, the respective part belt does not necessarily have a varying thickness over its total longitudinal extent, but the varying thickness can rather also extend only over a section of the longitudinal extent of the respective part belt. The thickness of the first and second part belts along the third arm can, for example, be at least substantially constant, while it varies along the first or second arms, in particular along the total first or second arms. A thickened portion can, for example, contribute to making the part belt somewhat stiffer. A smaller stiffness of the first and second arms, along which only a respective part band extends, can thereby be compensated in comparison with the third arm along which both the first and second part belts extend.

The thickness of the respective part belt preferably varies in that a longitudinal edge of the respective part belt is thickened with respect to an opposite longitudinal edge, in particular with respect to the remaining respective part belt. One of the two longitudinal edges of the respective part belt can be formed as a bead, for example. Such a thickened portion can in particular be produced in a technical weaving manner when the part belt is woven. The thickened portion can, however, alternatively or additionally also be caused, for example, in that a plastic inlay runs through the part belt in the region of the thickened portion.

In accordance with a preferred further development, at least one of the part belts is at least sectionally thickened in that direction, and in particular has an at least sectionally thickened longitudinal edge aligned in that direction, in which the first arm is arranged relative to the second arm. If the first arm is arranged in the direction of travel relative to the second arm as explained above, the respective part belt is consequently thickened in the direction of travel. The longitudinal edge of the respective part belt facing in the direction of travel is in particular thickened with respect to the opposite longitudinal edge, that is the longitudinal edge oriented against the direction of travel.

Such a design can in particular have aerodynamic advantages. For a reinforcement of the respective part belt can be achieved by the thickened portion oriented in the direction of travel and the tendency of the part belt to flutter in the airstream that flows around the respective part belt against the direction of travel can in particular be reduced by said reinforcement. A fluttering of the part belt can in this respect not only be perceived as disturbing by the helmet wearer, but as a rule also results in an increase in the air resistance. An advantageous reduction of the air resistance can therefore in particular be achieved by the thickened design of the strap belt or of the individual part belts in the direction of travel for helmets that are used as part of sports competitions at high speeds, for instance time trials.

The initially named object is additionally satisfied by a helmet having a helmet strap as described above for fastening the helmet to a respective head, in particular in accordance with one of the above-described embodiments. The helmet strap in this respect preferably comprises two at least substantially similar strap belts that are each fastened at the first and second arms of their respective Y shape to a respective helmet side of the helmet such that the respective first arm is arranged in front of the second arm with respect to a front side of the helmet. The improved safety of the helmet strap in particular effected by the fixed interconnection or by the materially integral embodiment of the two part belts along the third arm of a respective strap belt in this respect produces a correspondingly improved safety of the helmet comprising such a helmet strap. The advantages of the described individual embodiments of the helmet strap can also be transferred in a corresponding manner to a respective helmet having a corresponding helmet strap.

The initially named object is furthermore satisfied by a method of manufacturing a helmet strap as described above, in particular in accordance with one of the above-described embodiments. The method preferably comprises the weaving of a belt, with the weaving comprising the steps: weaving a single-strip first section; weaving a double-strip second section; and weaving a single-strip third section. In this respect, the named sections preferably adjoin one another directly or connected in the named order by transit regions. The weaving of the first, second and third sections preferably takes place without interruption over the sections for this purpose.

The intermediate result of such a weaving is therefore a belt that comprises two strips in a middle section, namely in the named second section, that is it comprises two generally mutually separate part belts that, however, run together with the respective other part belt at their two ends and in this respect are woven together from there along the first or third sections so that the belt is formed as a single strip along the first or third sections. Since the sections adjoin one another, the part belts that are separate in the double-strip second section each both also extend into the single-strip sections where they are woven into a uniform fabric.

The method furthermore preferably comprises as a further step the dividing of the second section to produce two strap belts which are in particular at least substantially mirror-symmetrical with respect to one another, which have a Y shape, whose first and second arms are formed by a respective port of the divided double-strip second section, and whose third arm is formed by the single-strip first or third section respectively. The helmet strap to be manufactured can then comprise both strap belts to be fastened to the one helmet side by two arms of the one strap belt and to the other helmet side by two arms of the other strap belt such that the strap belts can overall engage around the head of the respective helmet wearer from helmet side to helmet side when they are connected to one another in the chin region by their respective further arm. A secure purchase of the helmet at the head can hereby be achieved.

The weaving of such a belt can be directly followed by the weaving of a next such belt and so on. Single-strip sections and double-strip sections can in this respect continuously alternate. In this manner, a generally continuous belt can be manufactured, in particular without interruption, and then in each case only has to be divided at least substantially in the middle of the single-strip and double-strip sections to obtain strap belts having a Y shape that are in particular formed as alternatingly mirror-symmetrical with respect to one another and that can be used in pairs for a respective helmet strap.

Provision can furthermore in particular be made that the first, second and third sections are woven without interruption so that the same warp threads of the belt extend through the first, second and third sections. Despite the respective double-strip section the woven belt is thus a single-part, materially integral element that therefore has a comparatively high tear resistance and separation strength of the two part belts, in particular in comparison with two part belts only sewn together or connected by means of a connection element.

The folding over of one of the two strips of the respective divided double-strip section can follow the step of dividing the belt into strap belts to produce an angled course of this strip so that the first and second arms of the resulting Y shape of the respective strap belt run apart from the junction. The folding over can furthermore subsequently be fixed in that the sections of the strap belt that overlap due to the folding over are in particular fastened to one another by means of at least one seam and/or by adhesive bonding or welding.

The strap belts for the helmet straps to be produced can thus overall be manufactured in a comparatively simple manner and in particular at continuously high process speeds.

The invention will be described in more detail in the following only by way of example with reference to the drawings.

Figure 2:
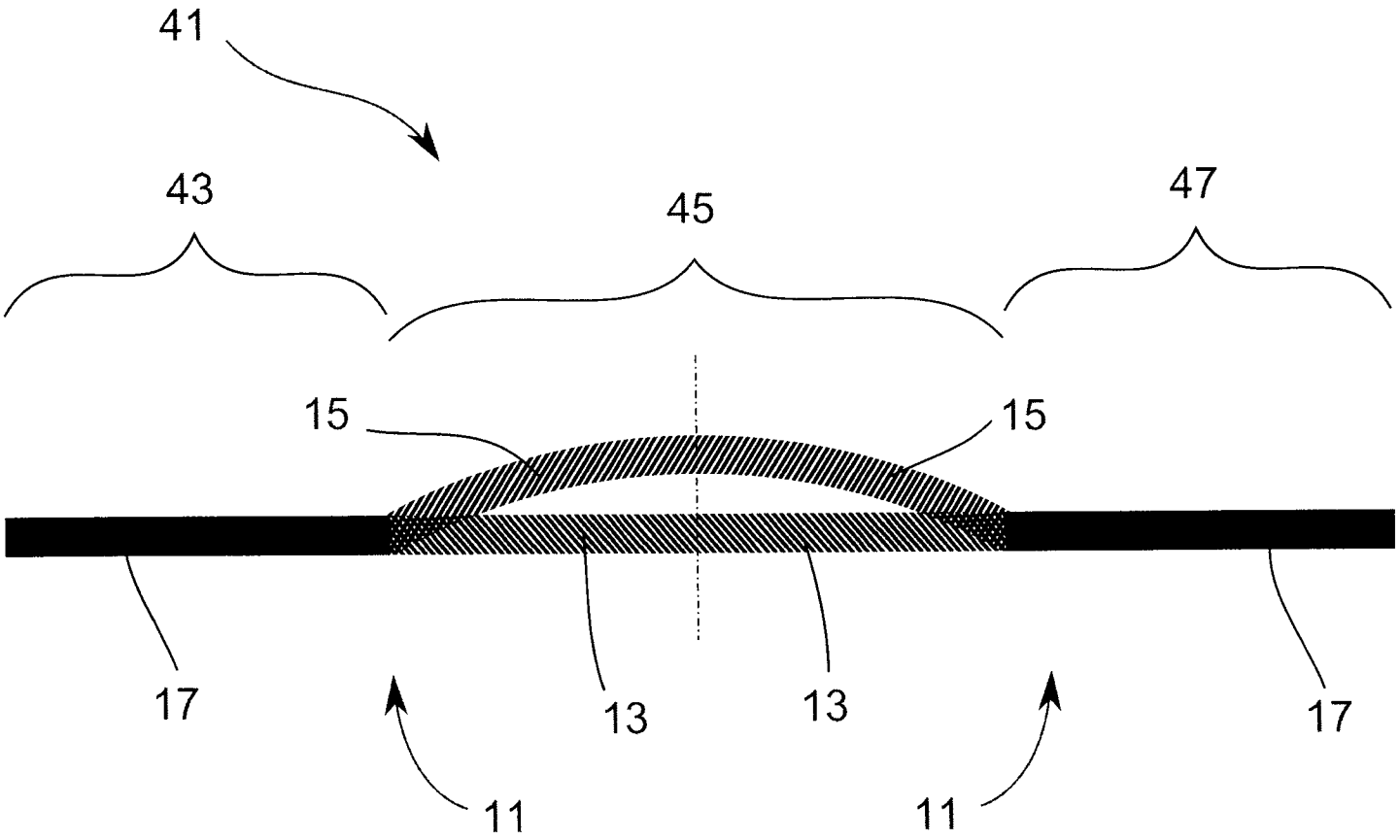

FIG. 1 shows a detail of a schematically represented strap belt of an embodiment of the helmet strap in accordance with the invention and respective cross-sections through the Y shape of the belt strap; and FIG. 2 shows a belt woven for the manufacture in accordance with the invention of a helmet strap in a schematic representation.

Only the one strap belt 11 of a helmet strap comprising a total of two mutually mirror-symmetrical strap belts 11 is shown in FIG. 1. The strap belt 11 is not shown completely in this respect, but rather only a middle section of the strap belt 11 is shown in which the first arm 13, the second arm 15 and the third arm 17 of the Y shape of the strap belt 11 run together. The arms 13, 15, 17 therefore appear shortened and the ends of the arms 13, 15, 17 facing away from the region of the transition 19 between the arms 13, 15, 17 are not shown.

The strap belt 11 is configured to be fastened to the helmet for which the strap belt is provided by the respective ends of the first and second arms 13, 15 at a respective helmet side. The first and second arms 13, 15 extend from there to the named transition region 19 that forms a junction of the Y shape and at which the first and second arms 13, 15 run together. The third arm 17 then extends from the transition region 19 further away from the helmet such that its end can be connected to the corresponding end of the third arm of the other strap belt in a chin region, in particular beneath the chin, to hold the helmet securely at the head. In this respect, the first arm 13 and the third arm 17 are aligned in parallel with one another, at least when the strap belt is spread out, as shown, in a flat and non-distorted manner, such that the third arm 17 represents a flush extension of the first arm 13. The second arm 15, in contrast, is aligned angled with respect to the third arm 17, with the angle in the embodiment shown amounting to approximately 45°.

The strap belt 11 comprises a first part belt 21 and a second part belt 23. The first part belt 21 that comprises a first part fabric 25 extends with a straight course without interruption along the total first arm 13 beyond the transition region 19 and further along the total third arm 17. The second part belt 23 that comprises a second part fabric 27 extends without interruption along the total second arm 15 over the transition region 19 and further along the total third arm 17, with the course of the second part belt 23 being angled in the transition region 19. The first and second part belts 21, 23 are in this respect woven to form a uniform fabric 29 along the third arm 17 so that they are materially integral with one another. In this respect, warp threads of the first part belt 21 run through the first and third arms 13, 17, while warp threads of the second part belt 23 run through the second and third arms 15, 17 of the Y shape of the strap belt 11.

The respective section of the first and second part belts 21, 23 in which the first and second part belts 21, 23 are woven with one another, and the respective section of the first and second part belts 21, 23 in which the first and second part belts 21, 23 are separate from one another adjoin one another along a folding edge 31. The section of the second part belt 23 separate from the first part belt 21 is folded over with respect to the remaining second part belt 23 at this folding edge 31. The angled course of the second part belt 23 results from this folding over, with the angle corresponding to the angle of approximately 45°, named above with respect to the shown embodiment, between the second and third arms 15, 17, along which the second part belt 23 extends. To produce this angle, the folding edge 31 in the embodiment shown is accordingly aligned at an angle of approximately 22.5° relative to the longitudinal extent of the first or third arms 13, 17.

To keep the part belt 23 folded over, a seam 33 is provided that extends in parallel with the alignment of the first or third arms 13, 17. The individual seam 33 is sufficient, due to the arrangement of the seam 33 relatively closely to the longitudinal edge 35' of the first part belt 31 from where the second arm 15 extends away, to hold the sections of the second part belt 23 that overlap one another due to the folding over sufficiently areally at one another such that the angled alignment of the second arm 15 is reliably maintained relative to the first or third arms 13, 17.

Schematic cross-sections through the respective arm 13, 15, 17 are shown in a respective extension of the arms 13, 15, 17 of the strap belt 11 shown shortened. It can be recognized at the cross-sections that all three arms 13, 15, 17 have an at least substantially flat shape with two mutually opposite flat sides 37, 37' that are connected at both sides over a respective longitudinal edge 35, 35'.

Whereas the third arm 17 has an at least substantially constant thickness, i.e. an at least substantially constant spacing between the flat sides 37, 37', the thickness varies in the first and second arms 13, 15 to the extent that the one longitudinal edge 35 is thickened with respect to the remaining part belt 21, 23 and in particular with respect to the opposite longitudinal edge 35'. A bead 39 is thereby formed along the longitudinal edge 35—that is not restricted to the absolute margin of the respective part belt 21, 23, but rather extends as shown over a part of the width of the part belt 21, 23, in particular over at least a sixth and/or over at most half the width, preferably over at most a third of the width.

The bead 39 is in this respect formed at that longitudinal edge 35 that faces in the direction in which the first arm 13 is arranged relative to the second arm 15 and that corresponds to the direction of travel F with a helmet put on and with a helmet wearer traveling forward, i.e. in the direction of gaze. This has the consequence that during travel an airstream impacts the thickened, and consequently reinforced longitudinal edge 35, so that the strap belt 11 hardly produces any air resistance, in particular since it does not start to flutter.

Since the first and second part belts 21, 23 are woven together in the third arm 17, the third arm 17 is, as a comparison of the cross-sections also shows, thicker and thus stiffer overall than the separate part belts 21, 23 along the first or second arms 13, 15—at least where the bead 39 is not formed. No correspondingly varying thickness is therefore provided at the third arm 17. In general, however, the thickness of the third arm 17 can also be formed as varying in a corresponding or at least similar manner.

A belt 41 is shown in FIG. 2 that is woven in accordance with the method in accordance with the invention. The belt 41 has a first section 43 (at the left in FIG. 2), a second section 45 (middle) and a third section 47 (at the right) that directly adjoin one another without interruption. In this respect, the second section 45 arranged between the first and third sections 43, 47 above all differs from the two others that it is not formed in one strip (shown continuously in black), but rather in two strips (shown in strips). The total belt 41 can in this respect be woven continuously over the named sections 43, 45, 47.

The division of the belt 41 into two strips at the transition between the first section 43 and the second section 45 can be achieved, for example, in that half of the warp threads of the fabric (e.g. every second one or alternatingly in bundles) is raised with respect to the other half at the start of the second section 45 so that the two halves are arranged at different levels and can be woven with respectively different weft threads (or with respectively different parts of the weft thread that is optionally multi-threaded in the first section 43). To combine the two strips of the second section 45 to one strip again at the start of the third section 47, the warp threads can then again be arranged in one level and can be woven together by one or more weft threads.

Strap belts 11 for the helmet strap to be produced can then be produced from a belt 41 produced in this manner in that the belt 41 is divided at the center of the double-strip second section 45 along the line shown chain-dotted. The two parts of the belt 41 then each form a strap belt 11 in accordance with the invention having a Y shape whose first and second arms 13, 15 are formed by the two strips of the divided double-strip second section 45 and whose third arm 17 is formed by the single-strip first and third sections 43, 37. The two strap belts 11 produced in this manner can thus be almost identical, but at least mirror-symmetrical with respect to one another with regard to their shape, but optionally also with regard to their weave structure.

The weaving does not have to be ended or interrupted after the weaving of the third section 47. Single-strip and double-strip sections 43, 45, 47 can rather generally alternate continuously over any desired length. A plurality of strap belts 11 can then be produced from such a woven belt 41 by dividing the alternatingly single-strip and double-strip sections, in particular respectively at the center of their respective longitudinal extent.

In this manner, not only the stability, in particular the tear-resistance and the separation strength, of a strap belt 11 generated in this manner is improved with respect to a strap belt composed of a plurality of parts, but the manufacture is also simplified, particularly since connection steps or connection elements can be dispensed with that would be required for connecting respective parts of a multi-part strap belt.

REFERENCE NUMERALS

11 strap belt
13 first arm
15 second arm
17 third arm
19 transition region
21 first part belt
23 second part belt
25 first part fabric
27 second part fabric
29 uniform fabric
31 folding edge
33 seam
35, 35' longitudinal edge
37, 37' flat side
39 bead
41 belt
43 first section
45 second section
47 third section
F direction of travel

The invention claimed is:

1. A helmet strap for a helmet, comprising at least one strap belt having a Y shape that has a first arm, a second arm, and a third arm, wherein a first one and a second one of the first arm, the second arm and the third arm are configured to be fastened to the helmet, wherein a third one of the first arm, the second arm and the third arm extends up to a chin region, wherein the strap belt comprises a first part belt and a second part belt, wherein the first part belt extends without interruption along the first and third arms and the second part belt extends without interruption along the second and third arms, with the first and second part belts being fixedly interconnected along the third arm or being formed materially integrally with one another along the third arm, wherein the second part belt has an angled course in the region of a transition between the second and third arms, and wherein the second part belt is folded over along a folding edge in the region of the transition between the second and third arms to produce the angled course.

2. A helmet strap in accordance with claim 1, wherein the first arm is provided relative to the second arm for arrangement in a direction of travel (F).

3. A helmet strap in accordance with claim 1, wherein the first part belt comprises a first part fabric that extends without interruption along the first arm and along the third arm and the second part belt comprises a second part fabric that extends without interruption along the second arm and along the third arm, with the first and second part fabrics being woven to one another along the third arm.

4. A helmet strap in accordance with claim 1, wherein the first part belt has an at least substantially straight course over a total extent of the first part belt along the first and third arms.

5. A helmet strap in accordance with claim 1, wherein the second part belt has an angled course in the region of the transition between the second and third arms at an angle in an angular range from approximately 30° to approximately 50°.

6. A helmet strap in accordance with claim 1, wherein sections of the second part belt overlap one another and are fastened to one another.

7. A helmet strap in accordance with claim 6, wherein the sections of the second part belt that overlap one another are fastened to one another by at least one of: at least one seam, adhesive bonding, or welding.

8. A helmet strap for a helmet, comprising at least one strap belt having a Y shape that has a first arm, a second arm, and a third arm, wherein a first one and a second one of the first arm, the second arm and the third arm are configured to be fastened to the helmet, wherein a third one of the first arm, the second arm and the third arm extends up to a chin region, wherein the strap belt comprises a first part belt and a second part belt, wherein the first part belt extends without interruption along the first and third arms and the second part belt extends without interruption along the second and third arms, with the first and second part belts being fixedly interconnected along the third arm or being formed materially integrally with one another along the third arm, wherein at least one of the first and second part belts has a varying thickness at least sectionally.

9. A helmet strap in accordance with claim 8, wherein the first part belt has a varying thickness at least along the first arm and/or wherein the second part belt has a varying thickness at least along the second arm.

10. A helmet strap in accordance with claim 9, wherein a longitudinal edge of the respective part belt is thickened with respect to an opposite longitudinal edge.

11. A helmet strap in accordance with claim 8, wherein at least one of the first and second part belts is formed at least sectionally thickened in that direction in which the first arm is arranged relative to the second arm.

12. A helmet in accordance with claim 1, wherein the helmet strap comprises two at least substantially similar strap belts that are each fastened by the first and second arms of their respective Y shape to a respective helmet side of the helmet such that the respective first arm is arranged in front of the second arm with respect to a front side of the helmet.

13. A method of manufacturing a helmet strap including at least one strap belt having a Y shape that has a first arm, a second arm, and a third arm, wherein a first one and a second one of the first arm, the second arm and the third arm are configured to be fastened to the helmet, wherein a third one of the first arm, the second arm and the third arm extends up to a chin region, wherein the strap belt comprises a first part belt and a second part belt, wherein the first part belt extends without interruption along the first and third arms and the second part belt extends without interruption along the second and third arms, with the first and second part belts being fixedly interconnected along the third arm or being formed materially integrally with one another along the third arm, the method including weaving a belt that comprises the following steps:

weaving a single-strip first section;

weaving a double-strip second section; and weaving a single-strip third section, wherein the second section lies between the first section and the third section, wherein the first section is directly connected to the second section or adjoins the second section by a transition region, and wherein the second section is directly connected to the third section or adjoins the third section by a transition region;

further including dividing the second section to produce two strap belts having a Y shape whose first and second arms are formed by a respective part of the divided double-strip second section and whose third arm is formed by the single-strip first or third section.

14. A method in accordance with claim 13, wherein the step of dividing the second section produces the two strap belts symmetrical to one another.

15. A method in accordance with claim 13, wherein the first, second and third sections are woven without interruption.

16. A method in accordance with claim 15, wherein the first, second and third sections are woven without interruption such that warp threads of the belt extend through the first, second and third sections.

17. A helmet in accordance with claim 8, wherein the helmet strap comprises two at least substantially similar strap belts that are each fastened by the first and second arms of their respective Y shape to a respective helmet side of the helmet such that the respective first arm is arranged in front of the second arm with respect to a front side of the helmet.

18. A helmet strap for a helmet, comprising at least one strap belt having a Y shape that has a first arm, a second arm, and a third arm, wherein a first one and a second one of the first arm, the second arm and the third arm are configured to be fastened to the helmet, wherein a third one of the first arm, the second arm and the third arm extends up to a chin region, wherein the strap belt comprises a first part belt and a second part belt, wherein the first part belt extends without interruption along the first and third arms and the second part belt extends without interruption along the second and third arms, with the first and second part belts being fixedly interconnected along the third arm or being formed materially integrally with one another along the third arm, wherein the first part belt comprises a fabric having warp threads that run through the first part belt continuously from one end of the first part belt along the first and third arms up to an opposite end of the first part belt, and wherein the second part belt comprises a fabric having warp threads that run through the second part belt continuously from one end of the second part belt along the second and third arms up to an opposite end of the second part belt.

* * * * *